US009389564B2

(12) United States Patent
Sekiguchi et al.

(10) Patent No.: US 9,389,564 B2
(45) Date of Patent: Jul. 12, 2016

(54) IMAGE FORMING APPARATUS FOR PERFORMING REGISTRATION AND DENSITY CORRECTION CONTROL

(71) Applicant: CANON KABUSHIKI KAISHA, Tokyo (JP)

(72) Inventors: Takashi Sekiguchi, Yokohama (JP); Shinri Watanabe, Mishima (JP); Takeshi Shimba, Kawasaki (JP); Ken Nakagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 13/855,880

(22) Filed: Apr. 3, 2013

(65) Prior Publication Data

US 2013/0302048 A1 Nov. 14, 2013

(30) Foreign Application Priority Data

May 11, 2012 (JP) ..... 2012-109934

(51) Int. Cl.
*G03G 15/00* (2006.01)
*G03G 15/01* (2006.01)

(52) U.S. Cl.
CPC ..... *G03G 15/5041* (2013.01); *G03G 15/0189* (2013.01); *G03G 15/5058* (2013.01); *G03G 2215/0161* (2013.01); *G03G 2215/0164* (2013.01)

(58) Field of Classification Search
CPC ..... G03G 15/5041; G03G 15/5058; G03G 2215/0161; G03G 2215/0164
USPC ..... 399/49, 301
See application file for complete search history.

(56) References Cited

U.S. PATENT DOCUMENTS 6,381,435 B2 4/2002 Shinohara et al.
7,020,404 B2 3/2006 Fukuda et al.
7,315,378 B2 1/2008 Phelan et al.
7,432,494 B2 * 10/2008 Kanzaki ..... 250/226

(Continued)

FOREIGN PATENT DOCUMENTS

CN 1716116 A 1/2006
JP 1-167769 A 7/1989

(Continued)

OTHER PUBLICATIONS

Office Action in Chinese Patent Application No. 201310163402.9, dated Apr. 3, 2015.

*Primary Examiner* — David Bolduc
(74) *Attorney, Agent, or Firm* — Fitzpatrick, Cella, Harper & Scinto

(57) ABSTRACT

An image forming apparatus includes: an image forming unit configured to form, on an image carrier, a first correction pattern including developer images of a plurality of colors, and a second correction pattern including developer images of the plurality of colors; a registration correction unit configured to perform registration correction control based on a detection result of the developer images of the first correction pattern; and a density correction unit configured to perform density correction control based on a detection result of the second correction pattern. The density correction unit is further configured to decide a detection result of the developer image of at least one color of the second correction pattern used for the density correction control based on a detection result of the developer image of the first correction pattern.

22 Claims, 10 Drawing Sheets

(56) References Cited

U.S. PATENT DOCUMENTS

| | | | | |
|---|---|---|---|---|
| 7,453,480 | B2 * | 11/2008 | Nishikawa et al. | 347/116 |
| 7,542,058 | B2 | 6/2009 | Nishikawa et al. | |
| 7,630,672 | B2 * | 12/2009 | Baretsky et al. | 399/301 |
| 7,664,407 | B2 * | 2/2010 | Yamanaka et al. | 399/9 |
| 7,764,897 | B2 * | 7/2010 | Takezawa | 399/72 |
| 7,894,101 | B2 | 2/2011 | Ichinose et al. | |
| 7,940,418 | B2 * | 5/2011 | Eom | 358/1.18 |
| 7,952,774 | B2 * | 5/2011 | Ikeda | 358/518 |
| 8,045,871 | B2 * | 10/2011 | Monma et al. | 399/49 |
| 8,515,300 | B2 * | 8/2013 | Fuse et al. | 399/49 |
| 2003/0214568 | A1 * | 11/2003 | Nishikawa et al. | 347/116 |
| 2005/0041990 | A1 * | 2/2005 | Sugiyama | 399/49 |
| 2006/0176355 | A1 * | 8/2006 | An | 347/116 |
| 2007/0134013 | A1 * | 6/2007 | Soya et al. | 399/49 |
| 2008/0089706 | A1 * | 4/2008 | Nakazato et al. | 399/44 |
| 2008/0199202 | A1 * | 8/2008 | Muranaka | 399/88 |
| 2009/0067860 | A1 * | 3/2009 | Sakai et al. | 399/49 |
| 2010/0028058 | A1 * | 2/2010 | Eom | 399/301 |
| 2011/0158670 | A1 * | 6/2011 | Fuchimoto | 399/66 |
| 2011/0243588 | A1 * | 10/2011 | Saida | 399/49 |
| 2011/0280599 | A1 * | 11/2011 | Ino et al. | 399/44 |
| 2013/0022377 | A1 * | 1/2013 | Sugeta et al. | 399/301 |
| 2013/0156472 | A1 | 6/2013 | Watanabe | |
| 2013/0243458 | A1 * | 9/2013 | Suzuki et al. | 399/49 |

FOREIGN PATENT DOCUMENTS

| | | | |
|---|---|---|---|
| JP | 11-143171 | A | 5/1999 |
| JP | 2001-166553 | A | 6/2001 |
| JP | 2003-186278 | A | 7/2003 |
| JP | 2004-110018 | A | 4/2004 |
| JP | 2004-188665 | A | 7/2004 |
| JP | 2004-252172 | A | 9/2004 |
| JP | 2004-252321 | A | 9/2004 |
| JP | 2004-361406 | A | 12/2004 |
| JP | 2006-018007 | A | 1/2006 |
| JP | 2006-208266 | A | 8/2006 |
| JP | 2006-251652 | A | 9/2006 |
| JP | 2006-267644 | A | 10/2006 |
| JP | 2006-284892 | A | 10/2006 |
| JP | 2007-10744 | A | 1/2007 |
| JP | 2008-003396 | A | 1/2008 |
| JP | 2008-185914 | A | 8/2008 |
| JP | 2008-261864 | A | 10/2008 |
| JP | 2009-134037 | A | 6/2009 |
| JP | 2009-150690 | A | 7/2009 |
| JP | 2010-117735 | A | 5/2010 |
| JP | 2012-42884 | A | 3/2012 |

* cited by examiner

IMAGE FORMING APPARATUS FOR PERFORMING REGISTRATION AND DENSITY CORRECTION CONTROL

BACKGROUND OF THE INVENTION

1. Field of the Invention

The present invention relates to an image forming apparatus such as a copying machine or printer adopting an electrophotography method or electrostatic storage method and, more particularly, to an operation of controlling to detect the tint and position of the developer image of each color formed in the image forming apparatus.

2. Description of the Related Art

In a color image forming apparatus including a plurality of photosensitive members, misregistration between the images of respective colors occurs due to mechanical mounting errors between the respective photosensitive members, optical path length errors between laser beams for the respective colors, optical path changes of the laser beams, and the like. Furthermore, the image density of each color changes depending on various conditions such as the use environment of the apparatus and the number of print sheets, thereby changing the color balance, that is, the tint.

To solve this problem, the image forming apparatus performs registration correction and density correction between the images of the respective colors. Japanese Patent Laid-Open No. 11-143171 proposes a technique of forming a registration correction pattern and a density correction pattern on an intermediate transfer belt, thereby performing registration and density detection and correction. The technique described in Japanese Patent Laid-Open No. 11-143171 avoids increase in the cost and size of the apparatus by using a single detection unit to detect registration and density correction patterns.

Japanese Patent Laid-Open No. 2006-284892 discloses an arrangement in which during density correction a reference pattern of each color is formed on an intermediate transfer belt in order to use a detection result obtained at a position within a density correction pattern, where an output is stable. More specifically, the position of a density correction pattern to be used for density detection for each color is decided based on the reference pattern. Japanese Patent Laid-Open No. 2001-166553 proposes a technique of forming both registration and density correction patterns on an intermediate transfer belt, and performing registration and density correction operations in one sequence, thereby shortening a time taken for the correction operations.

When registration and density correction operations are performed in a single sequence, a plurality of registration correction patterns and a plurality of density correction patterns may be repeatedly formed on the intermediate transfer belt. This is done to avoid the influence of periodic variations occurring in the rotation period of photosensitive members and rollers for driving the intermediate transfer belt, which are caused by eccentricity of the photosensitive members and rollers. To perform registration and density correction operations in a single sequence, it is necessary to arrange the correction patterns within one round of the intermediate transfer belt. Along with the recent decrease in size of the image forming apparatus, the perimeter length of the intermediate transfer belt has shortened, and thus it is required to perform registration correction and density correction with high accuracy even using patterns with shorter lengths.

SUMMARY OF THE INVENTION

The present invention provides an image forming apparatus for performing registration correction and density correction with short correction patterns.

According to an aspect of the present invention, an image forming apparatus includes: an image forming unit configured to form, on an image carrier, a first correction pattern including developer images of a plurality of colors, and a second correction pattern including developer images of the plurality of colors; a registration correction unit configured to perform registration correction control based on a detection result of the developer images of the plurality of colors of the first correction pattern; and a density correction unit configured to perform density correction control based on a detection result of the developer images of the plurality of colors of the second correction pattern. The density correction unit is further configured to decide a detection result of the developer image of at least one color of the second correction pattern used for the density correction control based on a detection result of the developer image of the color of the first correction pattern.

Further features of the present invention will become apparent from the following description of exemplary embodiments with reference to the attached drawings.

DESCRIPTION OF THE EMBODIMENTS

Exemplary embodiments of the present invention will be described below with reference to the accompanying drawings. Note that components which are not necessary for a description of the embodiments are omitted from the accompanying drawings.

<First Embodiment>

Figure 1:
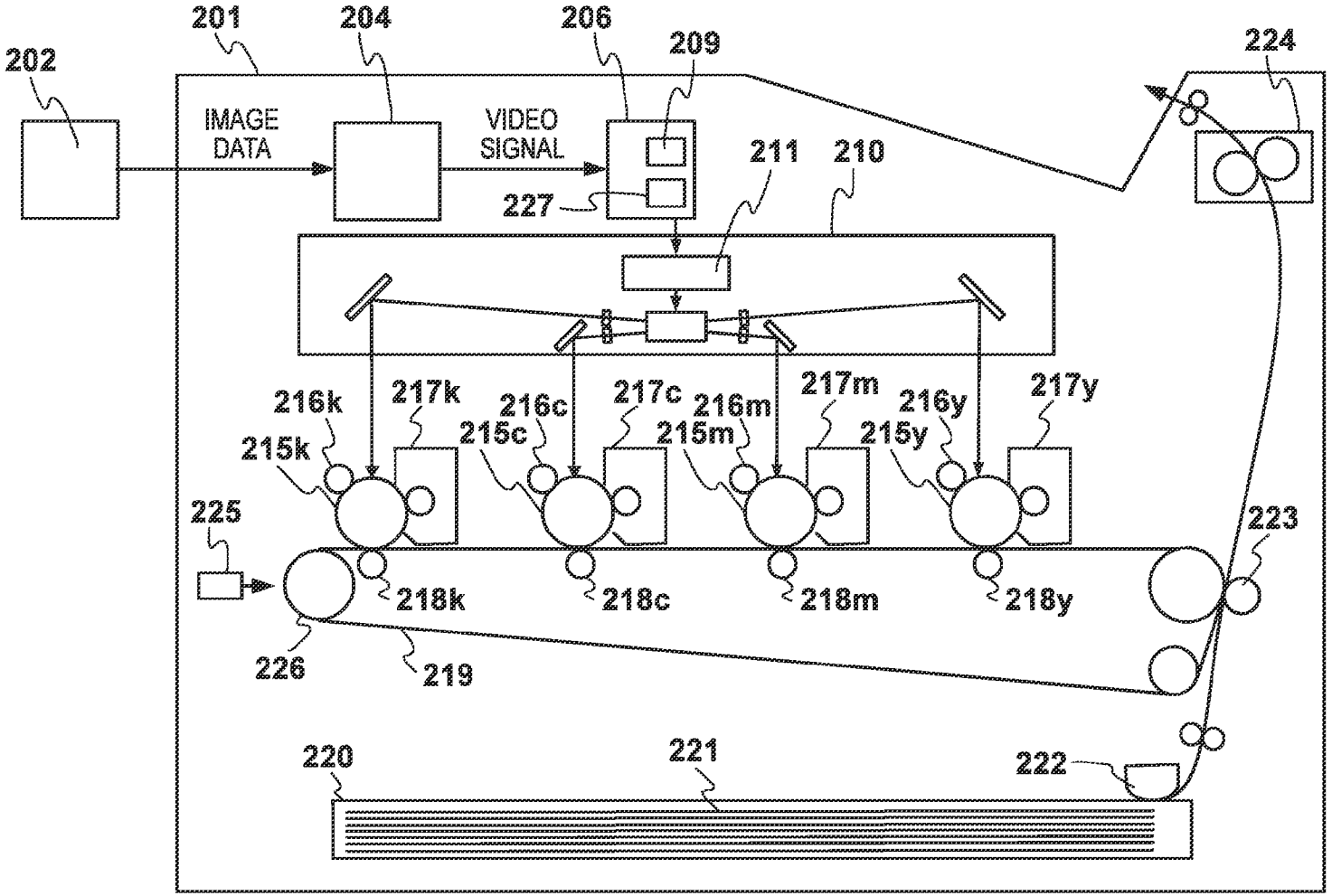
FIG. 1 is a view showing the arrangement of an image forming apparatus according to an embodiment.

FIG. 1 is a view showing the arrangement of an image forming apparatus 201 according to the present embodiment. The image forming apparatus shown in FIG. 1 forms a color image by superimposing images of four colors of yellow (Y), magenta (M), cyan (C), and black (K). Note that components denoted by reference numerals added with letters y, m, c, and k in FIG. 1 indicate members for forming yellow (Y), magenta (M), cyan (C), and black (K) toner images on an intermediate transfer belt 219. Note that in the following description, reference numerals without letters y, m, c, and k are used when colors need not be distinguished from each other.

Upon receiving image data from a host computer 202, a controller 204 of the image forming apparatus 201 generates a video signal in a desired signal format based on the received image data. An engine control unit 206 includes an arithmetic processing unit such as a CPU 209, and a storage unit such as a RAM 227, and outputs the video signal generated by the controller 204 to a scanning unit 210. The video signal is used to drive a light source 211, such as a laser diode, of the scanning unit 210. Based on the video signal, the light source 211 emits a laser beam for forming an electrostatic latent image on each photosensitive member 215 by scanning the rotating photosensitive member 215. Each photosensitive member 215 has been charged to a desired potential by a corresponding charging unit 216. An electrostatic latent image is formed on the surface of each photosensitive member 215 by emitting a laser beam to change the potential of the surface.

A developing unit 217 has toner as the developer of a corresponding color, and supplies the toner to the electrostatic latent image on the corresponding photosensitive member 215, thereby forming a toner image as a developer image on the photosensitive member 215. The toner image formed on each photosensitive member 215 is transferred to the intermediate transfer belt 219 as an endless belt by a bias voltage applied by a corresponding primary transfer unit 218. The toner images of the respective photosensitive members 215 are superimposed on one another, and transferred to the intermediate transfer belt 219 serving as an image carrier, thereby forming a color image. Note that a driving roller 226 controls rotation of the intermediate transfer belt 219. A secondary transfer unit 223 transfers the toner images on the intermediate transfer belt 219 to a printing material 221 which is picked up from a cassette 220 and conveyed through a conveyance path by a feed roller 222. A fixing unit 224 fixes the toner images on the printing material 221 by heat and pressure. In this embodiment, there is provided a sensor unit 225 for detecting correction patterns for registration correction and density correction, which are formed on the intermediate transfer belt 219. A detection result of the sensor unit 225 is sent to the CPU 209, and is used for correcting the densities and positions of other colors with respect to a reference color. Note that in the present embodiment, the intermediate transfer belt 219 is used as an image carrier on which correction patterns are formed. Correction patterns, however, can be formed on another image carrier to perform correction.

Figure 2:
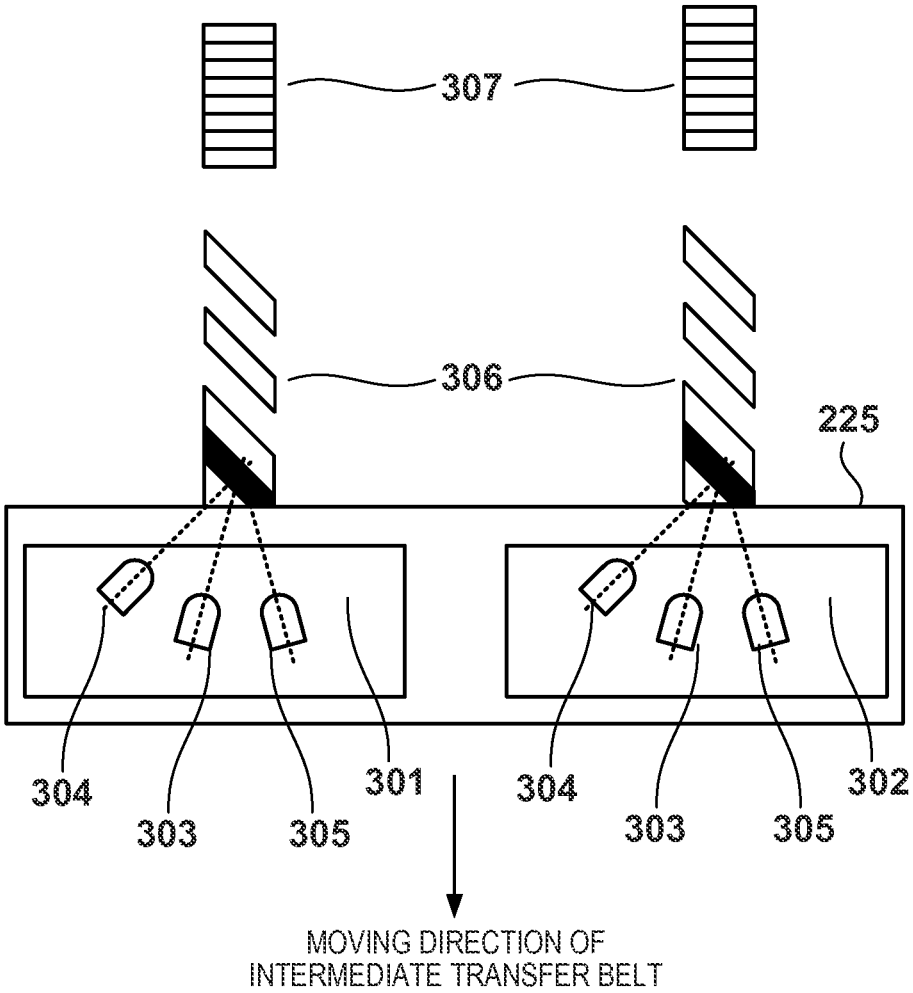
FIG. 2 is a view showing the arrangement of a sensor unit according to an embodiment.

FIG. 2 is a view showing the arrangement of the sensor unit 225 according to the present embodiment. The sensor unit 225 according to the present embodiment includes two sensors 301 and 302 with the same arrangement. The sensor 301 detects a correction pattern formed near one edge portion of the surface of the intermediate transfer belt 219 in a direction perpendicular to the moving direction. The sensor 302 detects a correction pattern formed near the other edge portion of the intermediate transfer belt 219. Each of the sensors 301 and 302 includes a light-emitting element 303 which emits light toward the intermediate transfer belt 219, and light-receiving elements 304 and 305 each of which receives light emitted by the light-emitting element 303 and reflected by the surface of the intermediate transfer belt 219 or the correction pattern formed on the surface. Note that the light-receiving element 304 is configured to receive diffuse reflection light from the surface of the intermediate transfer belt 219 or the correction pattern, and the light-receiving element 305 is configured to receive specular reflection light from the surface of the intermediate transfer belt 219 or the correction pattern. Each of the light-receiving elements 304 and 305 outputs a detection signal with a level corresponding to the amount of received light. Note that although two sensors are arranged in FIG. 2, three or more sensors may be provided. Note also that two or more sensors are used to detect misregistration, and one or more sensors are used to detect the density.

Figure 3:
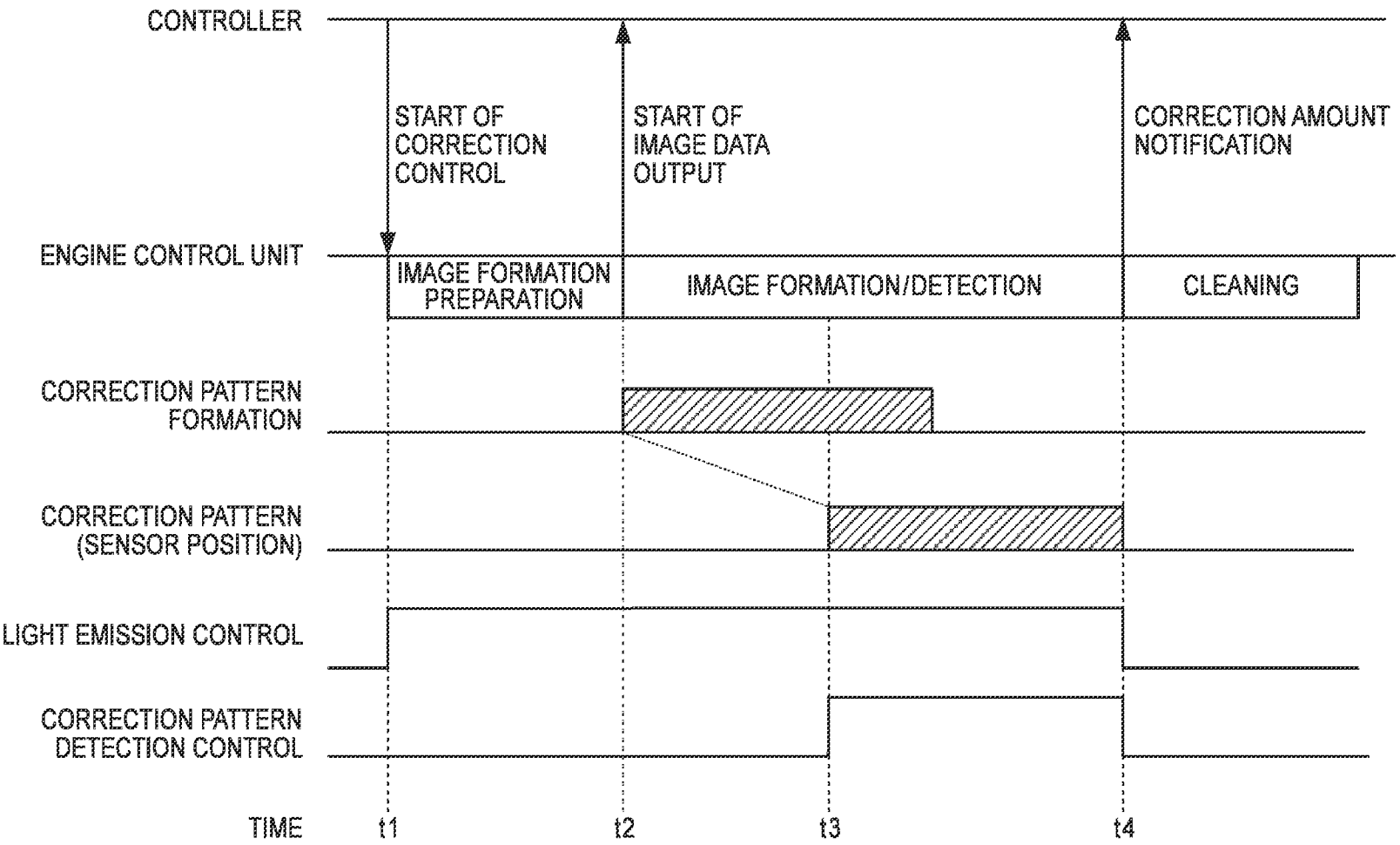
FIG. 3 is a timing chart showing correction control processing according to an embodiment.

FIG. 3 is a timing chart showing registration and density correction control processing according to the present embodiment. The registration and density correction control processing starts when the controller 204 notifies the engine control unit 206 of start of the correction control processing. Note that in FIG. 3, the controller 204 notifies the engine control unit 206 of start of the correction control processing at a time t1. Upon receiving a correction control start instruction, the engine control unit 206 starts to prepare for image formation. When the image formation preparation operation is completed at a time t2, the engine control unit 206 instructs the controller 204 to start output of image data. Note that in the image formation preparation operation, the engine control unit 206 starts light emission control of the light-emitting element 303 of the sensor unit 225. Upon receiving an image data output start instruction, the controller 204 outputs a video signal for forming a correction pattern to the engine control unit 206. The engine control unit 206 controls to form the correction pattern on the intermediate transfer belt 219. When the correction pattern formed on the intermediate transfer belt 219 reaches near the detection region of the sensor unit 225 at a time t3, the engine control unit 206 starts detection control of the correction pattern. When the detection control of the correction pattern ends at a time t4, the engine control unit 206 terminates the light emission control of the sensor unit 225, and notifies the controller 204 of detection values of the registration and density correction patterns or correction values calculated based on the detection values. The engine control unit 206 performs cleaning for the correction patterns on the intermediate transfer belt 219.

Figure 4A:
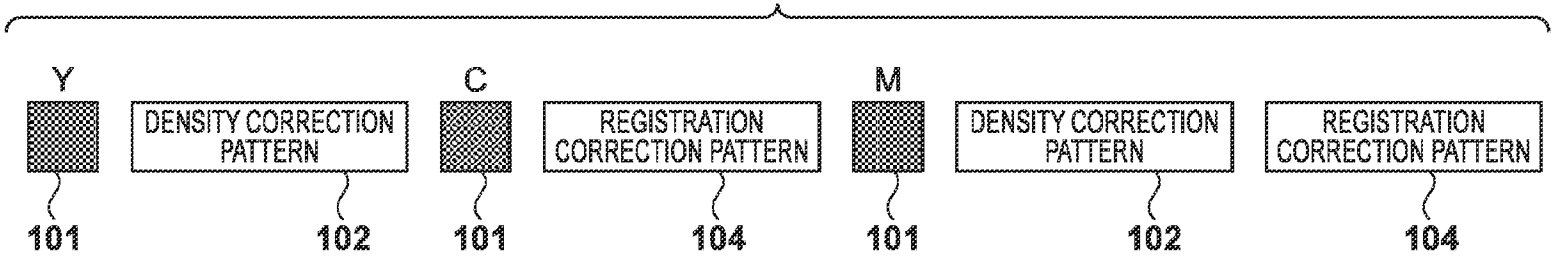
FIGS. 4A to 4C are views each showing correction patterns according to an embodiment.
Figure 4B:
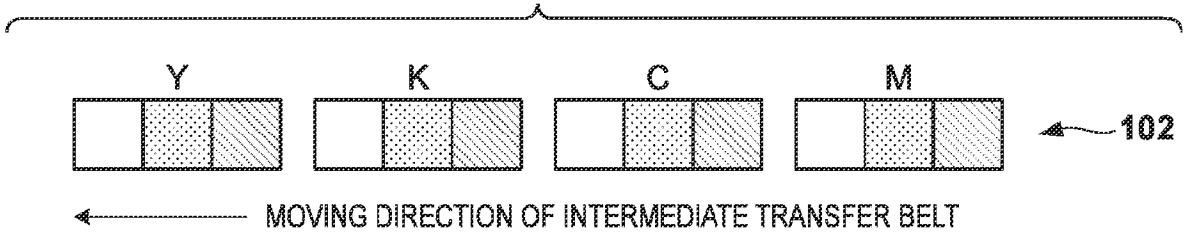
Figure 4C:
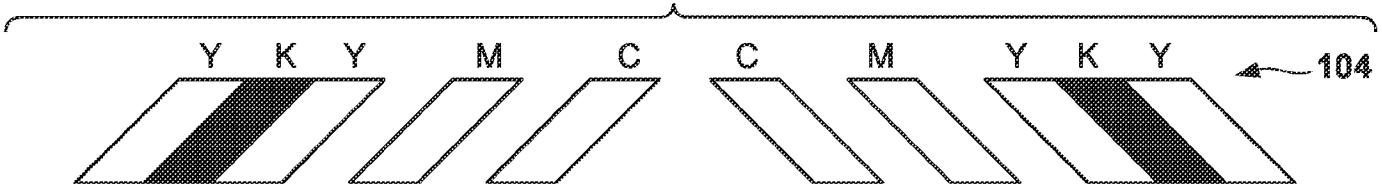

FIGS. 4A to 4C are views for explaining correction patterns formed on the intermediate transfer belt 219 according to the present embodiment. In the present embodiment, as shown in FIG. 4A, a pair of a density correction pattern 102 (second correction pattern) and a registration correction pattern 104 (first correction pattern) is successively formed a plurality of times (twice in FIG. 4A). Furthermore, reference patterns 101 of yellow (Y), cyan (C), and magenta (M) are respectively formed at the start, the end, or between the correction patterns. Note that a reference pattern of black (K) is not formed in this embodiment. Note also that each reference pattern 101 to be formed here is formed by, for example, a solid image with a sufficiently high density such that the sensor can reliably detect the image.

As shown in FIG. 4B, the density correction pattern 102 includes the density correction patterns of the respective colors. The density correction pattern of each color includes a plurality of toner images with different densities (tone levels). Note that although three tone levels are used in FIG. 4B, this is merely an example, and the density correction pattern can be formed by an arbitrary number of tone levels. In this embodiment, as shown in FIG. 4C, the registration correction pattern 104 includes a correction pattern obtained by forming a black toner image on a yellow toner image, a correction pattern of a magenta toner image alone, and a correction pattern of a cyan toner image alone. However, other patterns which enable to detect the positions of respective toner images may be used. For example, a correction pattern obtained by forming a black toner image on a magenta toner image, or a correction pattern obtained by forming a black toner image on a cyan toner image may be used. Note that each color of the registration correction pattern 104 is formed by, for example, a solid image with a sufficiently high density such that the sensor can reliably detect the image. In the following description, in the registration correction pattern 104, the yellow, magenta, and cyan portions will be respectively referred to as color regions, and a black portion will be referred to as a black region.

Figure 5:
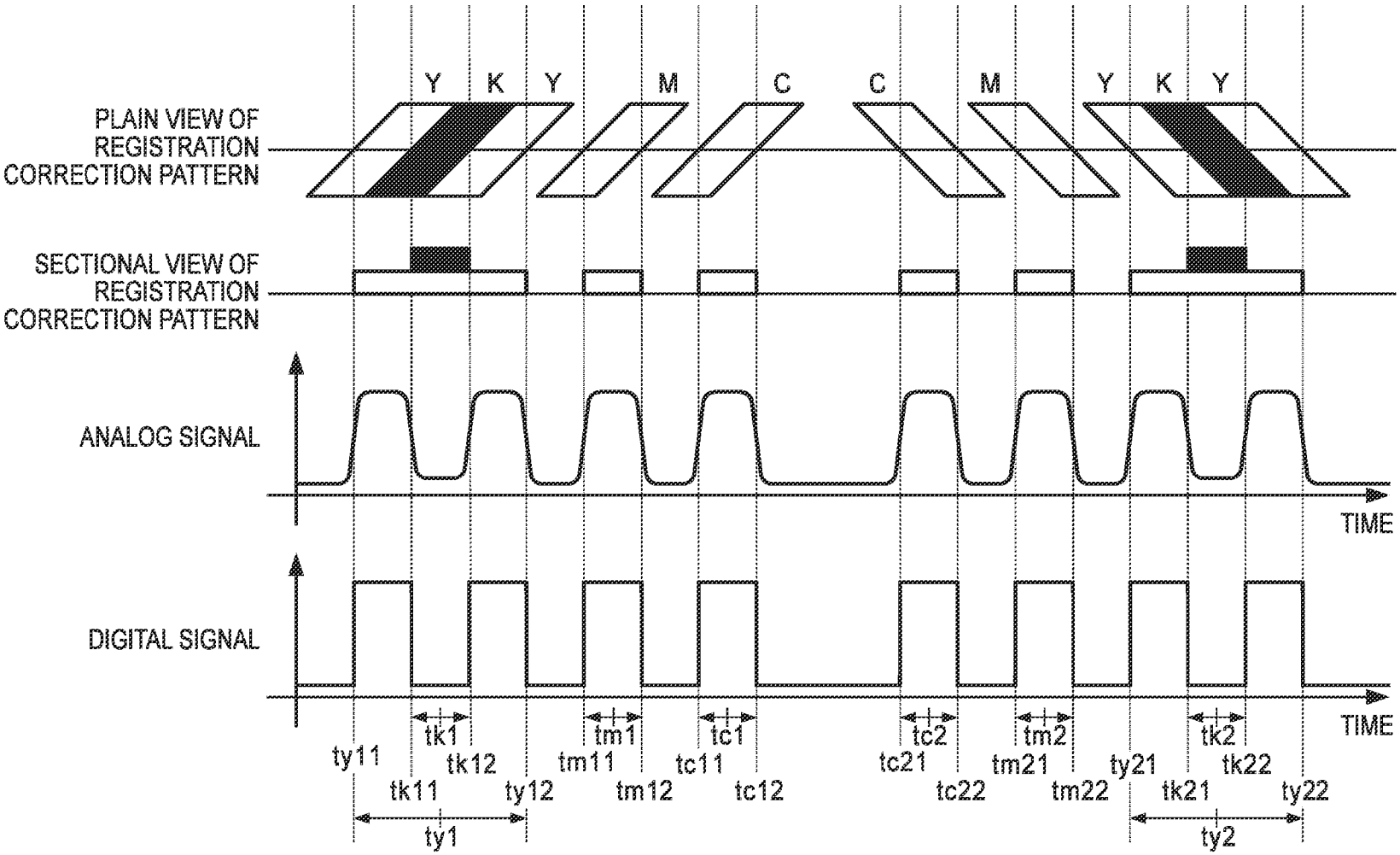
FIG. 5 is a timing chart for explaining detection of a misregistration amount according to an embodiment.

FIG. 5 is a timing chart for explaining a method of calculating the misregistration amounts of other colors in the sub-scanning direction with respect to a reference color according to the present embodiment. Note that in this embodiment, the reference color is yellow and the misregistration amounts of magenta, cyan, and black are calculated. FIG. 5 shows a signal output from the light-receiving element 304 which receives diffuse reflection light when the registration correction pattern 104 passes through the detection region of the sensors 301 and 302. Referring to FIG. 5, an analog signal indicates a signal output from the light-receiving element 304, and a digital signal indicates a signal obtained by using a threshold to perform binarization processing for the signal output from the light-receiving element 304. Note that letters with a two-digit number in the lowermost portion of FIG. 5 indicate the detection time of the leading edge or trailing edge of the digital signal. Assume that the time is the detection time of the boundary between the colors of the registration correction pattern 104. It is possible to obtain a time corresponding to the center position of the region of each color shown in FIG. 5 based on the detection times of the respective edges according to:

$$tk1=(tk11+tk12)/2$$

$$ty1=(ty11+ty12)/2$$

$$tm1=(tm11+tm12)/2$$

$$tc1=(tc11+tc12)/2$$

$$tk2=(tk21+tk22)/2$$

$$ty2=(ty21+ty22)/2$$

$$tm2=(tm21+tm22)/2$$

$$tc2=(tc21+tc22)/2$$

Times PDt_my, PDt_cy, and PDt_ky corresponding to the misregistration amounts of magenta, cyan, and black with respect to yellow as a reference color are calculated using the calculated times corresponding to the center positions of the respective regions according to:

$$PDt_my=((tm1-ty1)+(tm2-ty2))/2$$

$$PDt_cy=((tc1-ty1)+(tc2-ty2))/2$$

$$PDt_ky=((tk1-ty1)+(tk2-ty2))/2$$

Since each of the above values indicates the deviation amount of the detection time, it is possible to calculate the misregistration amount in the sub-scanning direction with respect to the reference color by multiplying the value by the speed of the intermediate transfer belt 219. Note that if misregistration in the main scanning direction occurs, the distance between two patterns of the same color of the registration correction pattern 104 changes. The misregistration amount in the main scanning direction is, therefore, calculated based on the change in distance. This is not necessary for the following description of the embodiment, and a detailed description thereof will be omitted.

Figure 6:
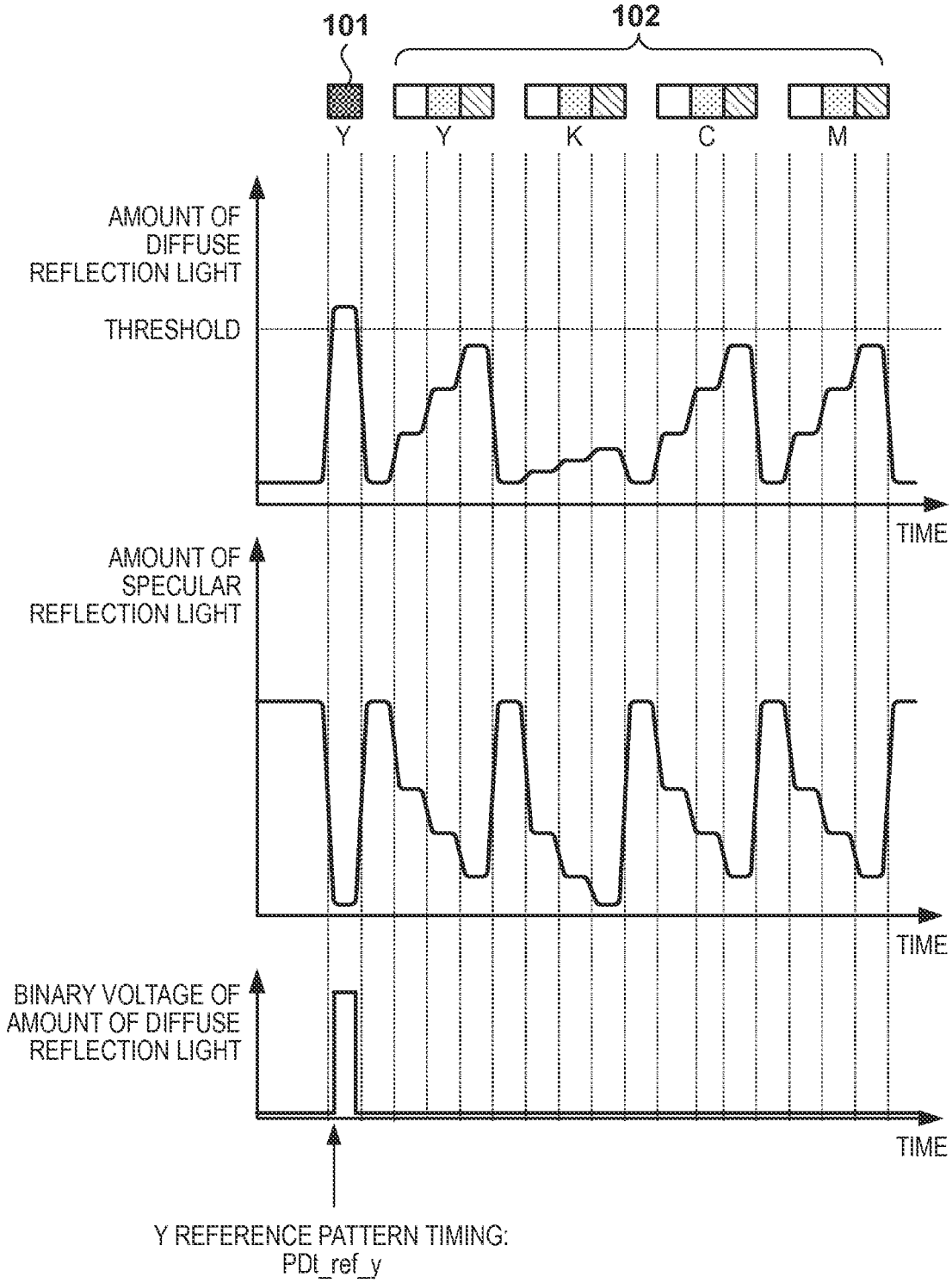
FIG. 6 is a timing chart showing the amounts of light received by a sensor when detecting a density correction pattern according to an embodiment.

FIG. 6 shows the amount of received light of the light-receiving element 304 which receives diffuse reflection light and that of the light-receiving element 305 which receives specular reflection light when the yellow reference pattern 101 and the density correction pattern 102 which are shown in FIG. 4A pass through the detection region of the sensors 301 and 302. Since the reference pattern 101 is formed by a solid image with a high density, the amount of diffuse reflection light from the reference pattern 101 is large, and the amount of specular reflection light from the reference pattern 101 is small, as shown in FIG. 6. As the density is higher, the amount of diffuse reflection light from the density correction pattern 102 is larger and the amount of specular reflection light from the density correction pattern 102 is smaller. Note that the amount of diffuse reflection light from the black region of the density correction pattern 102 is smaller than those from the color regions. Furthermore, the amount of diffuse reflection light from the surface of the intermediate transfer belt 219 is smallest, and the amount of specular reflection light from the surface of the intermediate transfer belt 219 is largest. The engine control unit 206 can execute binarization processing using a threshold shown in FIG. 6 for the amount of diffuse reflection light, and detect the position of the reference pattern 101 of yellow, as indicated by a signal waveform in the lowermost portion of FIG. 6.

Figure 7:
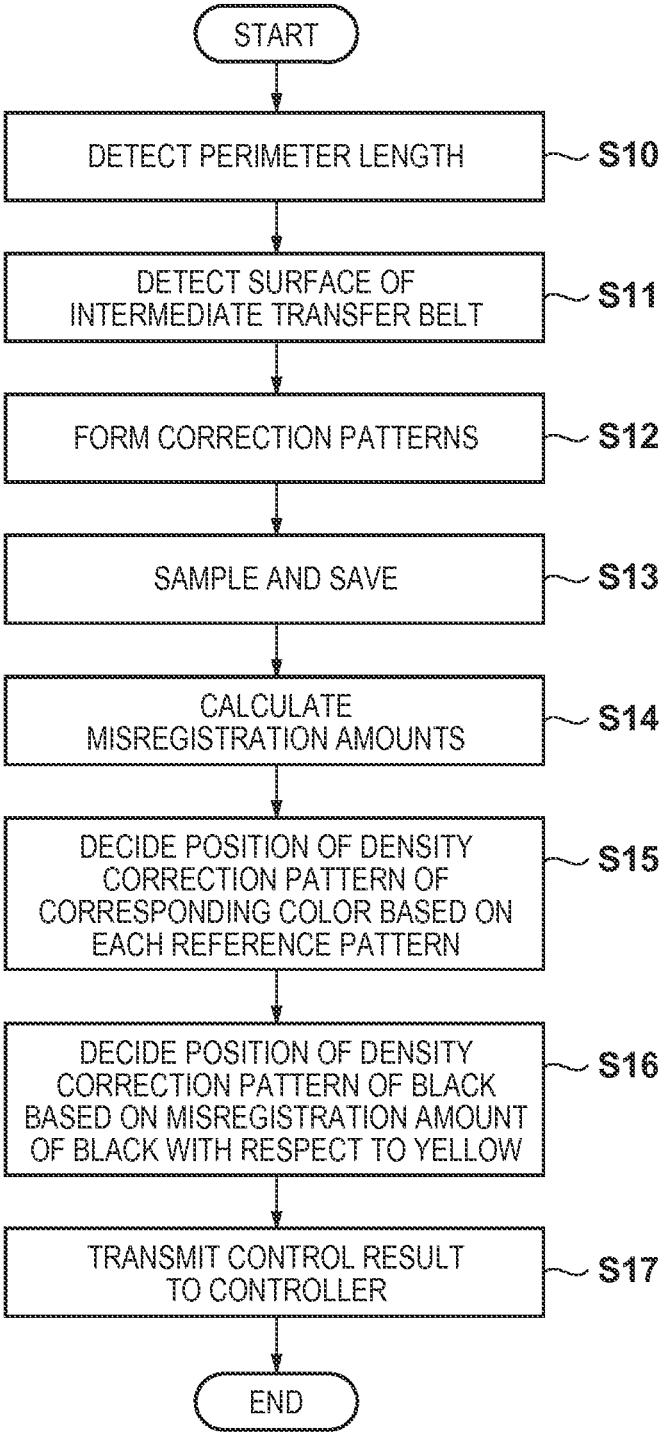
FIG. 7 is a flowchart illustrating correction control processing according to an embodiment.

FIG. 7 is a flowchart illustrating correction control processing according to the present embodiment. Upon receiving a correction control start instruction from the controller 204, the engine control unit 206 detects the perimeter length detection patch of the intermediate transfer belt 219 to specify the position of the intermediate transfer belt 219 in step S10. In step S11, to cancel the influence of the surface of the intermediate transfer belt 219 in density correction, the engine control unit 206 causes the sensors 301 and 302 to detect the surface of the intermediate transfer belt, and stores detected values in its RAM 227. That is, the engine control unit 206 samples the amount of reflected light from the surface of the intermediate transfer belt at predetermined intervals, and stores a sampling value in the RAM 227. After that, the engine control unit 206 controls to form the correction patterns shown in FIG. 4A on the intermediate transfer belt 219 in step S12.

In step S13, the engine control unit 206 samples signals corresponding to the amounts of received light of the light-receiving elements 304 and 305 while the correction patterns pass through the detection region of the sensors 301 and 302, and stores sampling values in the RAM 227. In step S14, the engine control unit 206 calculates the misregistration amounts of other colors with respect to the reference color based on the sampling value of the registration correction pattern 104 saved in the RAM 227. Since the registration correction pattern 104 is formed with a sufficiently high density, it is possible to specify a sampling value which is saved in the RAM 227 and corresponds to the registration correction pattern 104 based on a change in sampling value saved in the RAM 227 with time.

In step S15, the engine control unit 206 decides a sampling value corresponding to reflected light from the reference pattern 101 of each color among the sampling values saved in the RAM 227. Based on the time of the decided sampling value, the engine control unit 206 decides a sampling value corresponding to reflected light from the density correction pattern 102 of the same color. Since the sampling value corresponds to a position on the intermediate transfer belt 219, the above processing is equivalent to processing of deciding the position of the density correction pattern 102 of a corresponding color by determining or deciding the position of the reference pattern 101 of each color. Note that since the reference pattern 101 is formed with a sufficiently high density, it is possible to decide a sampling value corresponding to the reference pattern 101 by performing threshold determination for the sampling values of the diffuse reflection light saved in the RAM 227, as shown in FIG. 6. Furthermore, the distance between the reference pattern 101 and the density correction pattern 102 of the same color as that of the reference pattern 101 is almost constant irrespective of the misregistration amount between colors, and specifying the position of the reference pattern 101 enables to decide the position of the density correction pattern 102 of the corresponding color.

In step S16, the engine control unit 206 decides a sampling value corresponding to the density correction pattern 102 of black among the sampling values saved in the RAM 227. That is, the position of the density correction pattern 102 of black is decided. In this embodiment, since the reference pattern of black is not formed, it is impossible to decide the position of the density correction pattern 102 based on the reference pattern 101, unlike other colors. The engine control unit 206, therefore, decides the position of the density correction pattern 102 of black based on the position of the reference pattern of yellow and the misregistration amount, obtained in step S14, between black and yellow as a reference color. In step S17, the engine control unit 206 transmits the misregistration amount and the sampling values corresponding to the density correction patterns 102 of the respective colors to the controller 204 as a control result. Note that at this time, the engine control unit 206 selects a sampling value including the center of the toner image of each density where the value is stable, except for the edge region of the density correction pattern 102 of each color, and transmits it to the controller 204.

Note that in the flowchart shown in FIG. 7, after the sampling values are saved in the RAM 227, the saved sampling values are used to detect the position of the registration correction pattern 104. The position determination processing can be performed by processing a signal output from the light-receiving element 304 or 305 without temporarily saving the values in the RAM 227. If, for example, the reference pattern 101 of a given color is arranged before the density correction pattern 102 of the color, it is possible to specify the position of the density correction pattern 102 of the color from the signal output from the light-receiving element 304 or 305 based on the already decided position of the reference pattern 101. That is, if the reference pattern 101 of a given color is arranged before the density correction pattern 102 of the color, the sampling values saved in the RAM 227 may not be used.

Figure 8A:
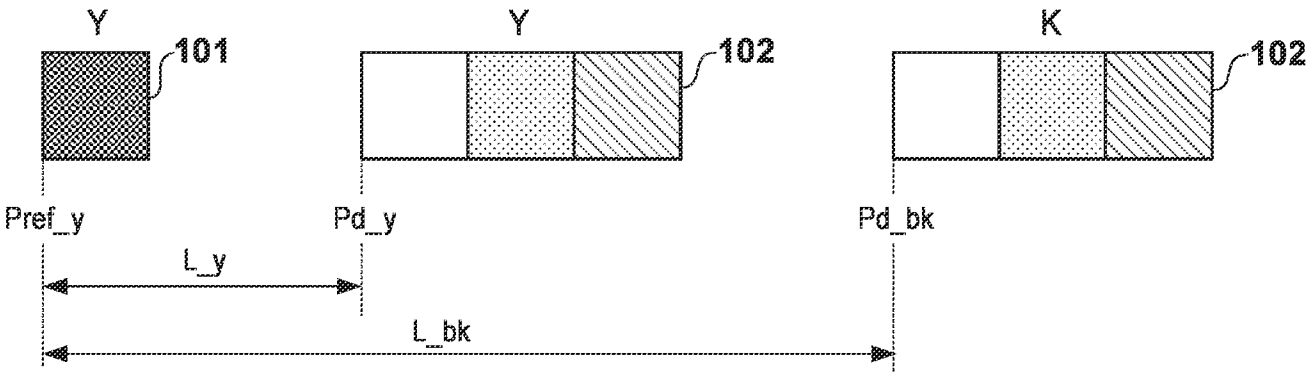
FIGS. 8A and 8B are explanatory views for identifying the position of a density correction pattern of a color for which no reference pattern is formed.

The processing of deciding the position of the density correction pattern 102 in steps S15 and S16 will be described in detail with reference to FIGS. 8A and 8B. Note that the position of each pattern is indicated by the left edge position in FIGS. 8A and 8B in the following description. This is merely an example, and the position of each pattern may be indicated by another position such as the intermediate position between the edges. FIG. 8A shows a case in which the misregistration amount of black with respect to yellow is 0. Let L_y be the distance between the reference pattern 101 of yellow and the density correction pattern 102 of yellow. Then, a position Pd_y of the density correction pattern 102 of yellow is calculated based on a detected position Pref_y of the reference pattern 101 of yellow according to:

$$Pd_y = \text{Pref}_y + L_y$$

Note that a time from when the reference pattern 101 of yellow is detected until the density correction pattern 102 of yellow is detected is decided based on the distance L_y and the speed of the intermediate transfer belt 219. It is, therefore, possible to specify a sampling value obtained from the density correction pattern 102 of yellow. Let L_bk be the distance between the reference pattern 101 of yellow and the density correction pattern 102 of black if there is no misregistration of a black toner image with respect to a yellow toner image. Then, a position Pd_bk of the density correction pattern 102 of black is calculated based on the detected position Pref_y of the reference pattern of yellow according to:

$$Pd_bk = \text{Pref}_y + L_bk$$

Figure 8B:
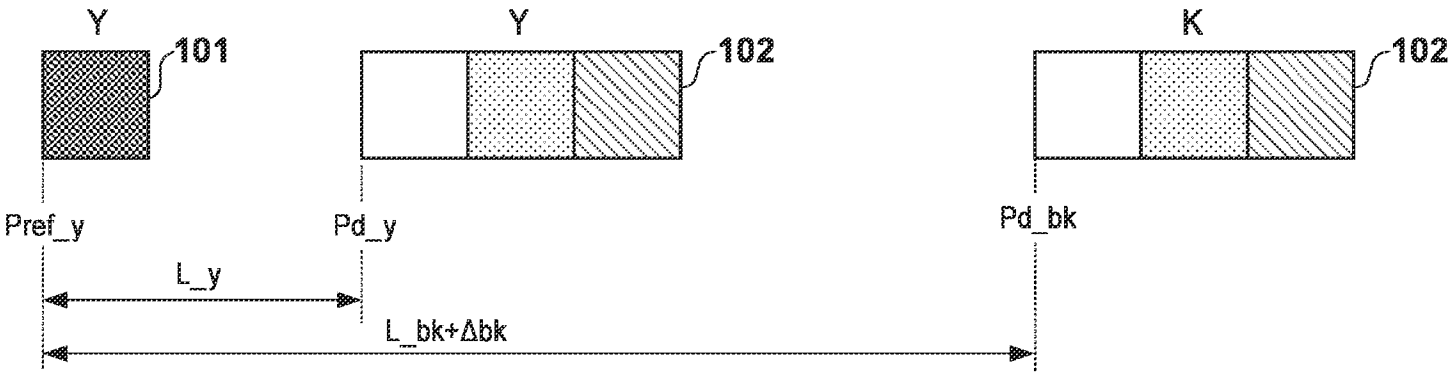

FIG. 8B shows a case in which the misregistration amount of black in the sub-scanning direction is Δbk in a direction opposite to the moving direction of the intermediate transfer belt 219. Note that the processing of calculating the misregistration amount in the sub-scanning direction is as described with reference to FIG. 5. In this example, processing of specifying the position of the density correction pattern 102 of yellow is the same as that described with reference to FIG. 8A, and a repetitive description thereof will be omitted. In this example, since misregistration has occurred in the density correction pattern 102 of black, the actual distance between the reference pattern 101 of yellow and the density correction pattern 102 of black is obtained by the actual distance L_bk+ the misregistration amount Δbk. The position Pd_bk of the density correction pattern 102 of black can be calculated based on the detected position Pref_y of the reference pattern 101 of yellow according to:

$$Pd_bk = \text{Pref}_y + L_bk + \Delta bk$$

A time from when the reference pattern 101 of yellow is detected until the density correction pattern 102 of black is detected is decided based on the actual distance L_bk+Δbk and the speed of the intermediate transfer belt 219. It is, therefore, possible to decide a sampling value obtained from the density correction pattern 102 of black.

As described above, in the present embodiment, the formation position of the density correction pattern 102 of black is specified based on the reference pattern 101 of yellow and the misregistration amount of black with respect to yellow without forming the reference pattern of black. This can shorten the length of the correction pattern.

<Second Embodiment>

Figure 9:
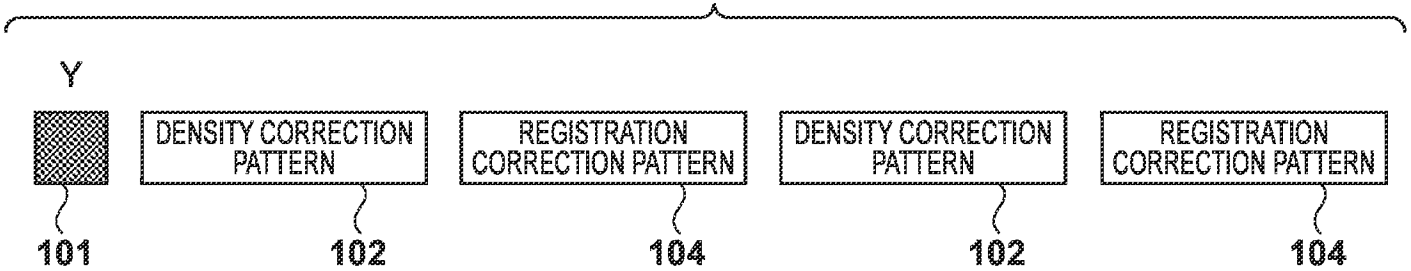
FIG. 9 is a view showing correction patterns according to an embodiment.

Different points of the present embodiment from the first embodiment will be mainly described below. In this embodiment, the reference patterns of magenta and cyan are not formed in addition to that of black. FIG. 9 shows correction patterns according to the present embodiment. Note that a density correction pattern 102 and a registration correction pattern 104 are as shown in FIGS. 4B and 4C.

Figure 10:
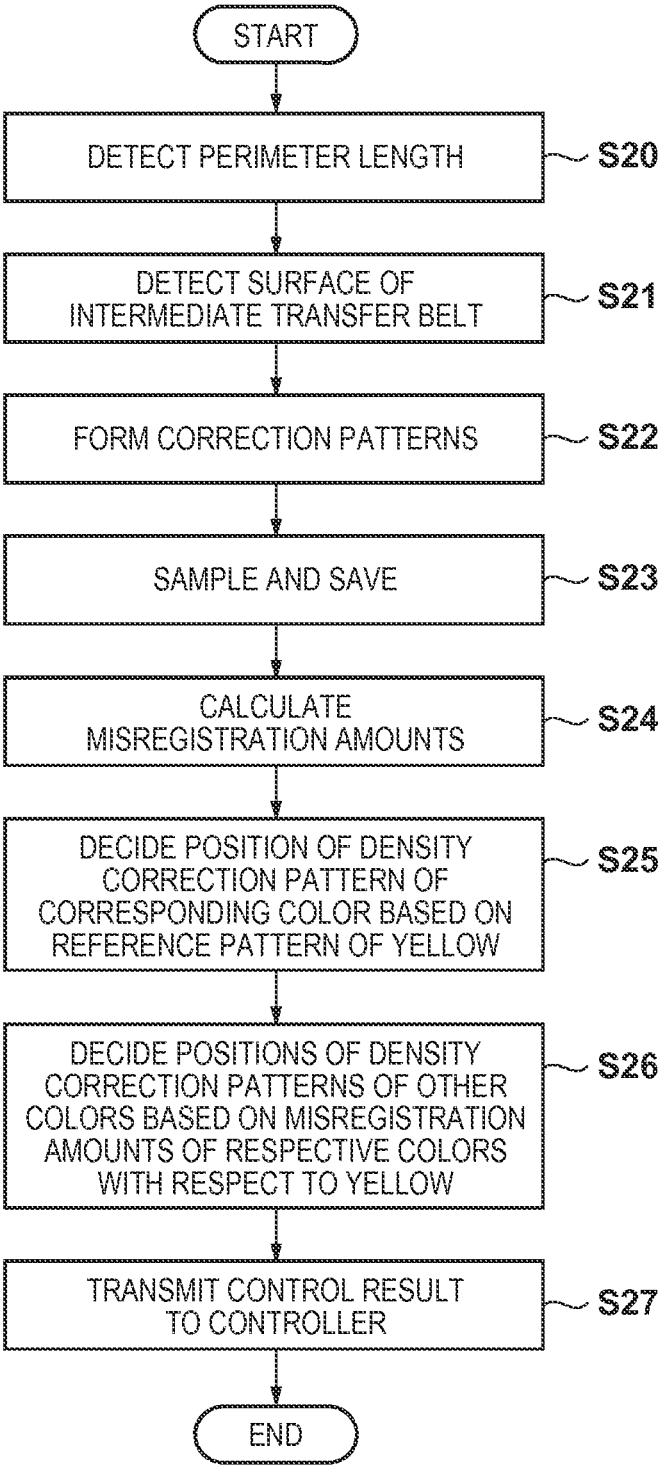
FIG. 10 is a flowchart illustrating correction control processing according to an embodiment.

FIG. 10 is a flowchart illustrating correction control processing according to the present embodiment. Note that processing in steps S20 to S24 is the same as that in steps S10 to S14 shown in FIG. 7, and a description thereof will be omitted. In step S25, an engine control unit 206 decides a sampling value corresponding to a reference pattern 101 of yellow among sampling values saved in a RAM 227, and decides a sampling value corresponding the density correction pattern 102 of yellow based on the decided sampling value.

In step S26, the engine control unit 206 decides sampling values corresponding to the density correction patterns 102 of cyan, magenta, and black among the sampling values saved in the RAM 227. That is, the positions of the density correction patterns 102 of cyan, magenta, and black are decided. In this embodiment, based on the position of the reference pattern of yellow and the misregistration amounts, obtained in step S24, of cyan, magenta, and black with respect to yellow as a reference color, the engine control unit 206 determines the positions of the density correction patterns 102 of cyan, magenta, and black. In step S27, the engine control unit 206 transmits the misregistration amounts and the sampling values corresponding to the density correction patterns 102 of the respective colors to a controller 204 as a control result. At this time, the engine control unit 206 selects a sampling value which is stable, except for the edge region of the density correction pattern 102 of each color, and transmits it to the controller 204.

Note that a method of deciding the position of the density correction pattern 102 based on the reference pattern of yellow as a reference color and a misregistration amount with respect to yellow, and specifying a sampling value is the same as that described with reference to FIGS. 8A and 8B, and a repetitive description thereof will be omitted.

In this embodiment, only the reference pattern of one color is formed, and the position of a density correction pattern is specified for other colors based on the position of the reference pattern and respective misregistration amounts with respect to the color of the reference pattern. This can further shorten the length of the correction pattern.

Note that only the reference pattern of one color is not formed in the first embodiment, and only the reference pattern of one color is formed in the second embodiment. The present invention is also applicable to a case in which no reference pattern is formed. In this case, the position of the density correction pattern 102 of the reference color is specified with reference to the position of the reference color of the registration correction pattern 104 in the sub-scanning direction. For other colors, the formation position of the density correction pattern 102 is specified based on the position of the reference color of the registration correction pattern 104 in the sub-scanning direction, the logical value of the formation position of the density correction pattern 102 based on the above position, and respective misregistration amounts with respect to the reference color. Alternatively, with reference to the position of each color of the registration correction pattern 104 in the sub-scanning direction, the position of the density correction pattern 102 of the same color can be specified.

If a reference pattern is not formed for all colors, the correction pattern can be shortened, and the number of colors for which a reference pattern is formed within the range can be arbitrarily selected. That is, a reference pattern can be formed for only some (a first color) of all the colors, and then no reference pattern need be formed for the remaining colors (a second color). Furthermore, in the above-described embodiment, for the density correction pattern 102 of a color for which no reference pattern is formed, the density is determined using the sampling values saved in the RAM 227. It is, however, possible to determine the density directly from the output signal of the sensor instead of the sampling values saved in the RAM 227 if, for example, the misregistration correction pattern 104 is formed first.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-109934, filed on May 11, 2012, which is hereby incorporated by reference herein in its entirety.

What is claimed is:

1. An image forming apparatus comprising:

an image forming unit configured to form, on an image carrier, a first correction pattern including developer images of a plurality of colors, and a second correction pattern including developer images of the plurality of colors;

a registration correction unit configured to perform registration correction control based on a detection result of the developer images of the plurality of colors of the first correction pattern;

a density correction unit configured to perform density correction control based on a detection result of the developer images of the plurality of colors of the second correction pattern; and a calculating unit configured to calculate a misregistration amount between a first color and a second color of the plurality of colors based on the detection result of the developer images of the plurality of colors of the first correction pattern, wherein the density correction unit is further configured to determine a detection result of a developer image of the second color of the second correction pattern used for the density correction control based on the misregistration amount between the first color and the second color.

2. The apparatus according to claim 1, wherein a timing of detecting the developer image of the second color of the second correction pattern used for the density correction control is determined based on the misregistration amount between the first color and the second color.

3. The apparatus according to claim 1, further comprising:

a sampling unit configured to sample a signal corresponding to reflected light of light emitted toward the image carrier, and a storage unit configured to store sampling values sampled by the sampling unit, wherein the density correction unit is further configured to determine, among the sampling values saved in the storage unit, a sampling value corresponding to reflected light from the developer image of the second color of the second correction pattern based on the misregistration amount between the first color and the second color.

4. The apparatus according to claim 1, wherein the image forming unit forms a reference pattern by a developer for the first color on the image carrier, and forms no reference pattern for the second color, and the density correction unit is further configured to determine a detection result of a developer image of the first color of the second correction pattern used for the density correction control based on the reference pattern of the first color, and determine the detection result of the developer image of the second color of the second correction pattern based on a detection result of a developer image of the second color of the first correction pattern.

5. The apparatus according to claim 4, wherein the density correction unit is further configured to determine the detection result of the developer image of the second color of the second correction pattern based on the misregistration amount between the first color and the second color, which has been obtained by the registration correction unit.

6. The apparatus according to claim 5, wherein the density correction unit is further configured to determine the detection result of the developer image of the second color of the second correction pattern based on the misregistration amount between the first color and the second color, and a distance between the reference pattern of the first color and the developer image of the second color of the second correction pattern when there is no misregistration of the second color with respect to the first color.

7. The apparatus according to claim 6, wherein the registration correction unit is further configured to detect misregistration of a remaining color with respect to a reference color of the plurality of colors based on the first correction pattern, and the first color is the reference color.

8. The apparatus according to claim 1, further comprising:

a detection unit configured to detect the first correction pattern and the second correction pattern by emitting light to the first correction pattern and the second correction pattern, and receive reflected light from the first correction pattern and the second correction pattern.

9. The apparatus according to claim 8, wherein the detection unit detects the first correction pattern and the second correction pattern at different timings.

10. The apparatus according to claim 1, wherein the first correction pattern and the second correction pattern are unfixed images formed on the image carrier.

11. The apparatus according to claim 1, wherein the image carrier is an intermediate transfer belt.

12. The apparatus according to claim 1, wherein correction information for the density correction control is obtained based on a detection result of the second correction pattern and a detection result of the image carrier on which the second correction pattern is formed.

13. An image forming apparatus comprising:

an image forming unit configured to form, on an image carrier, a first correction pattern including developer images of a plurality of colors, and a second correction pattern including developer images of the plurality of colors;

a detection unit configured to detect the unfixed first correction pattern and the unfixed second correction pattern formed on the image carrier;

a registration correction unit configured to perform registration correction control based on a detection result of the developer images of the plurality of colors of the first correction pattern;

a density correction unit configured to perform density correction control based on a detection result of the developer images of the plurality of colors of the second correction pattern; and a calculating unit configured to calculate a misregistration amount between a first color and a second color based on the detection result of the developer images of the plurality of colors of the first correction pattern, wherein the density correction unit is further configured to determine a position where a developer image of the second color of the second correction pattern used for the density correction control is formed based on the misregistration amount between the first color and the second color.

14. The apparatus according to claim 1, wherein the first correction pattern is followed by the second correction pattern in a moving direction of the image carrier.

15. The apparatus according to claim 1, wherein the first correction pattern and the second correction pattern are formed within a circumference of the image carrier.

16. An image forming apparatus comprising:

an image forming unit configured to form, on an image carrier, a first correction pattern including developer images of a plurality of colors, and a second correction pattern including developer images of the plurality of colors;

a registration correction unit configured to perform registration correction control based on a detection result of the developer images of the plurality of colors of the first correction pattern;

a density correction unit configured to perform density correction control based on a detection result of the developer images of the plurality of colors of the second correction pattern;

a sampling unit configured to sample a signal corresponding to reflected light of light emitted toward the image carrier; and a storage unit configured to store sampling values sampled by the sampling unit, wherein the sampling unit is further configured to sample a signal corresponding to reflected light from the developer images of the plurality of colors of the second correction pattern regardless of the detection result of the developer images of the plurality of colors of the first correction pattern, and to save sampling values corresponding to the second correction pattern;

wherein the density correction unit is further configured to determine a detection result of a developer image of at least one color of the second correction pattern used for the density correction control based on a detection result of a developer image of a corresponding color of the first correction pattern, and wherein the density correction unit is further configured to determine, among the sampling values saved in the storage unit, a sampling value corresponding to reflected light from the developer image of the at least one color of the second correction pattern based on the detection result of the developer image of the corresponding color of the first correction pattern.

17. An image forming apparatus comprising:

an image forming unit configured to form, on an image carrier, a first correction pattern including developer images of a plurality of colors and a second correction pattern including developer images of the plurality of colors;

a registration correction unit configured to perform registration correction control based on a detection result of the developer images of the plurality of colors of the first correction pattern; and a density correction unit configured to perform density correction control based on a detection result of the developer images of the plurality of colors of the second correction pattern, wherein the density correction unit is further configured to determine a detection result of a developer image of at least one color of the second correction pattern used for the density correction control based on a detection result of a developer image of a corresponding color of the first correction pattern, the image forming unit is further configured to form a reference pattern by a developer for a first color of the plurality of colors on the image carrier, and to form no reference pattern of a second color of the plurality of colors, and the density correction unit is further configured to determine a detection result of a developer image of the first color of the second correction pattern used for the density correction control based on the reference pattern of the first color, and to determine a detection result of a developer image of the second color of the second correction pattern based on a detection result of a developer image of the second color of the first correction pattern.

18. The apparatus according to claim 17, wherein a timing of detecting the developer image of the at least one color of the second correction pattern used for the density correction control is determined based on the detection result of the developer image of the corresponding color of the first correction pattern.

19. The apparatus according to claim 17, further comprising:

a sampling unit configured to sample a signal corresponding to reflected light of light emitted toward the image carrier; and a storage unit configured to store sampling values sampled by the sampling unit, wherein the density correction unit is further configured to determine, among the sampling values saved in the storage unit, a sampling value corresponding to reflected light from the developer image of the at least one color of the second correction pattern based on the detection result of the developer image of the corresponding color of the first correction pattern.

20. The apparatus according to claim 17, wherein the density correction unit is further configured to determine the detection result of the developer image of the second color of the second correction pattern based on a misregistration amount of the second color with respect to the first color, which has been obtained by the registration correction unit.

21. The apparatus according to claim 20, wherein the density correction unit is further configured to determine the detection result of the developer image of the second color of the second correction pattern based on the misregistration amount of the second color with respect to the first color, and a distance between the reference pattern of the first color and the developer image of the second color of the second correction pattern when there is no misregistration of the second color with respect to the first color.

22. The apparatus according to claim 17, wherein the first correction pattern and the second correction pattern are formed within a circumference of the image carrier.

* * * * *